US005493369A

United States Patent [19]

Sypula et al.

[11] Patent Number: 5,493,369

[45] Date of Patent: Feb. 20, 1996

[54] APPARATUS AND METHOD FOR IMPROVED LIQUID DEVELOPER IMAGE CONDITIONING

[75] Inventors: Donald S. Sypula, Penfield; Lawrence Floyd, Jr., Rochester; Shu Chang, Webster; Santokh S. Badesha, Pittsford; Christine J. Tarnawskyj, Webster, all of N.Y.

[73] Assignee: Xerox Corporation, Stamford, Conn.

[21] Appl. No.: 297,204

[22] Filed: Aug. 29, 1994

[51] Int. Cl.[6] ..... G03G 15/10

[52] U.S. Cl. ..... 355/256; 118/661

[58] Field of Search ..... 355/256, 257, 355/258, 245, 296, 298, 300, 301, 303, 215; 118/661, 662; 430/125

[56] References Cited

U.S. PATENT DOCUMENTS

| | | | |
|---|---|---|---|
| 3,609,029 | 9/1971 | Egnaczak | 355/256 |
| 4,258,115 | 3/1981 | Magome et al. | 430/125 |
| 4,286,039 | 8/1981 | Landa et al. | 430/119 |
| 4,684,238 | 8/1987 | Till et al. | 355/256 X |
| 4,690,539 | 9/1987 | Radulski et al. | 355/256 X |
| 4,878,900 | 11/1989 | Sundt | 604/119 |
| 4,941,021 | 7/1990 | Uchida et al. | 355/285 |
| 5,023,665 | 6/1991 | Gundlach | 355/256 |
| 5,028,964 | 7/1991 | Landa et al. | 355/273 |
| 5,332,642 | 7/1994 | Simms et al. | 430/125 |
| 5,352,558 | 10/1994 | Simms et al. | 430/125 |
| 5,404,209 | 4/1995 | Matsuoka et al. | 355/256 |

FOREIGN PATENT DOCUMENTS 0513820 11/1992 European Pat. Off. .

*Primary Examiner*—Sandra L. Brase

[57] ABSTRACT

A roller for improved conditioning of an image formed from a liquid developer comprised of toner particles and liquid carrier. A wire mesh uniformly covering an inner layer of the roller uniformly distributes an electrical bias closer to the surface of the roller and to the adjacent image bearing surface. The electrical bias has the same sign polarity as that of the toner particles of the image, to electrostatically repel and prevent the toner particles from entering the roller, and for compacting the toner particles to the image. The wire mesh reduces the electrical requirements of the materials used for the roller.

29 Claims, 5 Drawing Sheets

APPARATUS AND METHOD FOR IMPROVED LIQUID DEVELOPER IMAGE CONDITIONING

BACKGROUND OF THE INVENTION

This invention relates to an electrophotographic printing machine, and more particularly to a method and apparatus for removing toner dispersant from an image formed from a liquid developer.

A typical electrostatographic printing machine employs an imaging member that is exposed to an image to be printed. Exposure of the imaging member records an electrostatic latent image on it corresponding to the informational areas contained within the image to be printed. The latent image is developed by bringing a developer material into contact therewith. The developed image recorded on the photoconductive member is transferred to a support substrate such as paper, either directly or via an intermediate transport member. The developed image on the support substrate is generally subjected to heat and/or pressure to permanently fuse it thereto.

Two types of developer materials are typically employed in electrostatographic printing machines. One type of developer material is known as dry developer material and comprises toner particles or carrier granules having toner particles adhering triboelectrically thereto. Another type of developer material is a liquid material comprising a liquid carrier or dispersant having toner particles dispersed therein.

Liquid developer typically contains about 2 percent by weight of fine solid particulate toner material dispersed in the liquid carrier. The liquid carrier is typically a hydrocarbon. In the developing process, the developed image on the photoreceptor contains about 12 weight percent of particulate toner in liquid hydrocarbon carrier. To improve the quality of transfer of the developed image to a receiving member or copy sheet, the image should be conditioned. Conditioning an image includes increasing the percent solids in liquid by removing liquid carrier from the image while preventing toner particles from departing the image; and electrostatically compressing or compacting the toner particles of the image to physically stabilize the image and to produce a clear, high resolution image. Depending on the particular liquid carrier structural composition and its respective properties during the image formation process, e.g. vapor pressure rate, evaporation rate and volatility, the percentage of solids in the liquid should be increased to in the range of 25 to 75 percent. Removing the liquid dispersant minimizes image show-through on a support substrate and prevents problems associated with the image later emerging from the support material. Additionally, increasing the solids content of an image before transferring the image to an intermediate transport member greatly improves the ability of the toner particles to form a high resolution image on the transport member and thus on the support material. However, difficulty lies in separating and removing the liquid dispersant from the liquid developer, without disturbing the toner image. It is a critical step, nonetheless, not only to ensure that a high quality image is ultimately produced on a final substrate, but also to prevent toner particles from entering the liquid dispersant removal device, so that the device may remain clean and free from thereafter contaminating a subsequent image with embedded toner particles. Image offset is a serious instance of this problem where a toner impression of the partial or entire image embeds into the removal device, which may be in the form of a roller, causing it to reappear in a subsequent image, offset from the actual image, and causing blurred or multiple images on the final support substrate.

Increase in percent solids may be achieved by removing excess liquid carrier with a porous blotter in the form of a roller or belt (hereinafter collectively referred to as "roller"), typically positioned with respect to the photoconductive member retaining the latent image. When the developed image is transferred to an intermediate belt before final transfer to a final copy sheet, the developed image on the intermediate belt should again be blotted to further increase the percentage of toner solids, so that the amount of liquid on the final substrate is minimized, and a well defined, high quality image is produced.

A vacuum assisted blotter roller is effectively used to condition an image formed from a liquid developer. A vacuum absorption system is used to draw off liquid toner dispersant such as Isopar from an absorbent material which in turn is used to remove the dispersant from the toner image on an electrostatographic imaging member or intermediate transport member. Several advantages exist by eliminating excess dispersant by vacuuming the liquid through the roller, over other methods of liquid reduction found in the prior art. For example, less dispersant evaporates into the atmosphere, thus reducing pollution and potential health risks to individuals working near the machine. As the dispersant has a potential for being reused, it also makes the device more cost effective. In addition, the formed image is found to be more clearly defined, as the potential for the removed liquid from returning back to the image bearing surface from the roller and disturbing the image is eliminated. A vacuum assisted blotter roller is disclosed in U.S. Pat. No. 5,332,642, having a common assignee as the present application.

Preferably, the roller is electroconductive and a bias is applied to the roller having a potential of the same sign polarity as the toner in the liquid developer, so that the toner is repelled from the roller. By applying a bias potential to the roller, toner particles are prevented from entering the roller, and rather, remain in tact with the image. Furthermore, the toner image is compacted by the bias and/or pressure contact of the roller. The bias may be applied to the rigid, porous supportive core, or may be applied to both the rigid core and the absorbent material formed around the core. A bias applied to a conductive absorbent material, or to individual layers of a multi-layered absorbent material, allow the roller's electrical field to approach more closely to the toner image and thus exert a stronger repelling action than if the biased roller were separated from the toner image by an insulating absorbent material. Polymers such as various polyurethanes, olefins, tetrafluoroethylene, and various elastomers, may be processed into open cell absorbent polymeric foam material appropriate for use in blotter roller applications, using the teachings, for example, in U.S. Pat. Nos. 3,696,180; 3,729,536; 3,860,680; 3,968,292; 4,157,424, and other methods known in the art. Conductive fillers, organic and inorganic, ionic or electronic are useful and may be added to regulate the poromeric material conductivity. The porous supportive core typically is made from a sintered metal, plastic or ceramic, and is electroconductive, either by itself, or in combination with another conductive material.

Various techniques have been devised for removing excess liquid carrier from an imaging member which involve either a vacuum removal system or an electrical bias applied to a portion of the liquid dispersant removal device. The following references may be relevant to various aspects of the present invention.

U.S. Pat. No. 4,286,039 discloses an image forming apparatus comprising a deformable polyurethane roller, which may be a squeegee roller or blotting roller which is biased by a potential having a sign the same as the sign of tire charged toner particles in a liquid developer. The bias on the polyurethane roller is such that it prevents streaking, smearing, tailing or distortion of the developed electrostatic image and removes much of the liquid carrier of the liquid developer from the surface of the photoconductor.

U.S. Pat. No. 5,028,964 discloses an apparatus for image transfer which comprises an intermediate transfer member and a squeegee for removing excess liquid from the toner image prior to transferring an image. The intermediate transfer member is operative for receiving the toner image therefrom and for transferring the toner image to a receiving substrate. Transfer of the image to the intermediate transfer member is aided by providing electrification of the intermediate transfer member to a voltage having the same bias as that of the charged particles. The roller is charged to a potential having the same polarity as the charge of the toner particles of the liquid developer.

U.S. Pat. No. 4,878,090 discloses a development apparatus comprising a vacuum source which draws air around a shroud to remove excess liquid carrier from the development zone.

U.S. Pat. No. 5,023,665 discloses an excess liquid carrier removal apparatus for an electrophotographic machine. The apparatus is comprised of an electrically biased electrode having a slit therein coupled to a vacuum pump. The vacuum pump removes, through the slit in the electrode, liquid carrier from the space between the electrode and the photoconductive member. The electrical bias generates an electrical field so that the toner particle image remains undisturbed as the vacuum withdraws air and liquid carrier from the gap.

Copending file wrapper continuation application for U.S. patent Ser. No. 08/082,141, filed Apr. 12, 1993, and allowed on May 4, 1994, of parent application, Ser. No. 07/779,559, filed Oct. 18, 1991, now abandoned, and both having a common assignee as the present application, discloses a belt used for absorbing liquid toner dispersant from a dispersant laden image on a electrostatographic imaging member or intermediate transfer member. The angle of contact of the absorption belt is adjusted with respect to the image bearing member for maintaining proper cohesiveness of the image and absorption of liquid dispersant. The absorption belt is passed over a roller biased with the same charge as the toner. A pressure roller is in contact with the absorption belt for removal of liquid therefrom.

Copending application for U.S. patent Ser. No. 08/247,737, filed May 23, 1994, and having a common assignee as the present application, discloses a roller comprising an absorption material and a covering, which are adapted to absorb liquid carrier from a liquid developer image. The covering has a smooth surface with a plurality of perforations, to permit liquid carrier to pass through to the absorption material at an increased rate, while maintaining a covering having a smooth surface which is substantially impervious to toner particles yet pervious to liquid carrier so as to inhibit toner particles from departing the image.

U.S. Pat. No. 5,332,642, having a common assignee as the present application, discloses a porous roller for increasing the solids content of an image formed from a liquid developer. The liquid dispersant absorbed through the roller is vacuumed out through a central cavity of the roller. The roller core and/or the absorbent material formed around the core may be biased with the same charge as the toner so that the toner is repelled from the roller while the dispersant is absorbed.

Copending application for U.S. patent Ser. No. 08/107,876, filed Aug. 8, 1993, and having a common assignee as the present application, discloses a roller for removal of excess carrier liquid from a liquid developed image, comprising a rigid porous electroconductive supportive core, a conformable microporous resistive foam material provided around the core, and a pressure controller for providing a positive or negative pressure to the roller.

European Patent Application, publication number 0513820A2, filed May 15, 1992, describes a stabilizing roller comprising a deformable roller member including a soft open cell conductive foam, which is disposed on a biased slip ring formed on the outer surface of a central motor driven metal roller core member. A DC bias is applied to the slip ring, of the same polarity as the toner in the liquid developer, and of an opposite polarity to the counter ions within the isopar carrier fluid for transporting the toner on the surface of the photoreceptor drum.

SUMMARY OF THE INVENTION

In accordance with the invention, and in accordance with one aspect of the invention, there is provided a device for conditioning a liquid image including liquid carrier and toner particles. The device comprises a porous member, pervious to the liquid carrier and substantially impervious to the toner particles, a means for applying an electrical bias to said porous member, and a wire mesh associated with said porous member to substantially uniformly distribute the electrical bias about said porous member for electrostatically repelling the toner particles from said porous member. The device may further comprise a roller.

Pursuant to another aspect of the invention, there is provided a printing machine of the type having a surface with an image developed with a liquid developer comprising liquid carrier and toner particles, and a device for conditioning the liquid image. The device comprises a porous member, pervious to the liquid carrier and substantially impervious to the toner particles, a means for applying an electrical bias to said porous member, and a wire mesh associated with said porous member to substantially uniformly distribute the electrical bias about said porous member for electrostatically repelling the toner particles from said porous member.

DETAILED DESCRIPTION OF THE DRAWINGS

For purposes of illustration only, the invention is described in the context of an electrophotographic printing machine, however, it is understood that other electrostatographic reproduction machines using a liquid developer could find useful application of the present invention.

Figure 1:
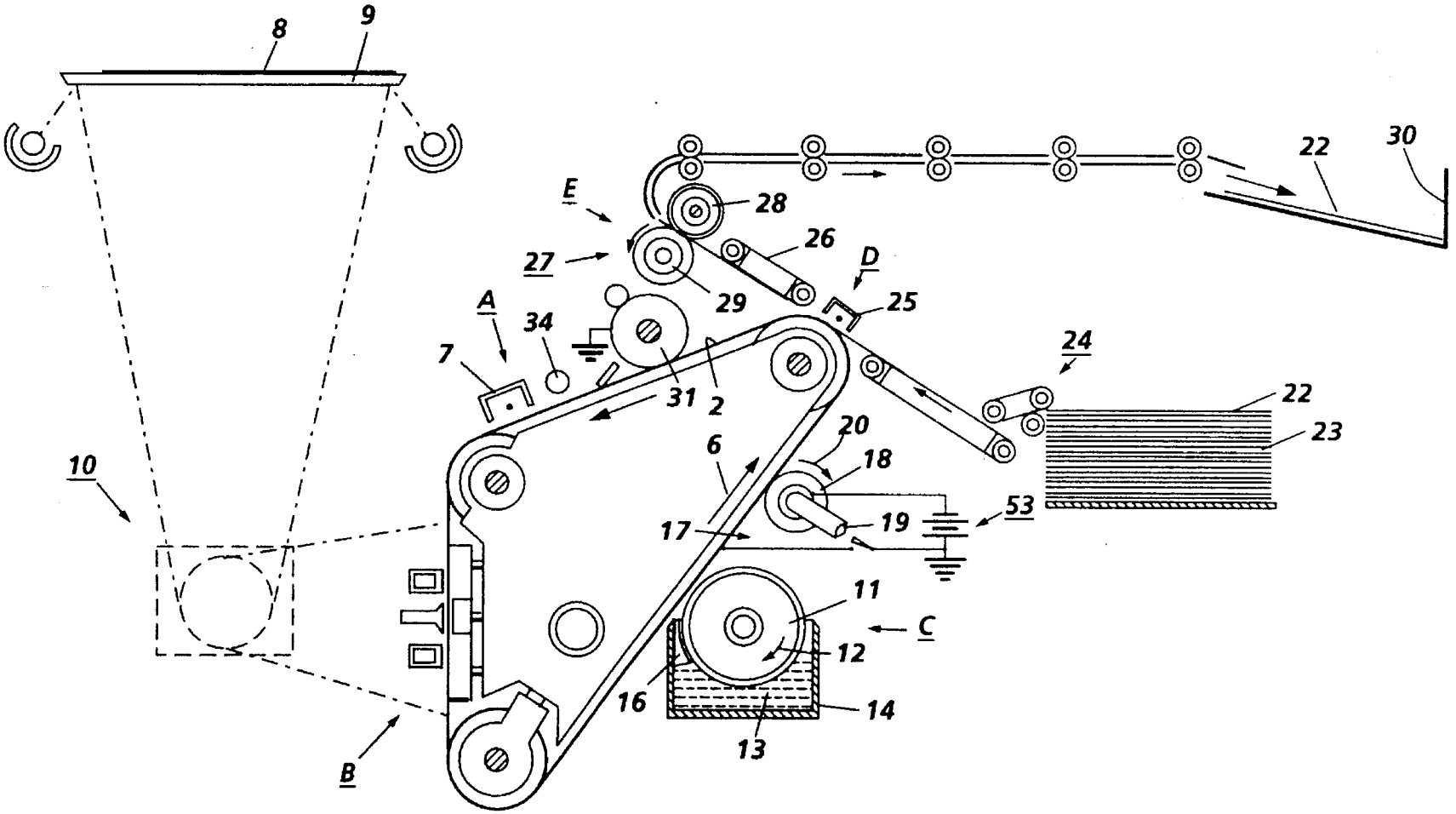
FIG. 1 is a schematic elevational view depicting an electrophotographic printing machine incorporating the features of the present invention.

In FIG. 1, printing machine 1 employs belt 2 having a photoconductive surface deposited on a conductive substrate. Initially, belt 2 passes through charging station A. At charging station A, a corona generating device 7 charges the photoconductive surface of belt 2 to a relatively high, substantially uniform potential.

After the photoconductive surface of belt 2 is charged, the charged portion is advanced to exposure station B. At exposure station B, an original document 8 is placed upon a transparent support platen 9. An illumination assembly, indicated generally by the reference numeral 10, illuminates the original document 8 on platen 9 to produce image rays corresponding to the document information areas. The image rays are projected by means of an optical system onto the charged portion of the photoconductive surface. The light image dissipates the charge in selected areas to record an electrostatic latent image on the photoconductive surface corresponding to the original document informational areas.

After the electrostatic latent image has been recorded, belt 2 advances the electrostatic latent image to development station C. At development station C, roller 11, rotating in the direction of arrow 12, advances a liquid developer material 13 from the chamber of housing 14 to development zone 17. An electrode 16 positioned before the entrance to development zone 17 is electrically biased to generate an AC field just prior to the entrance to development zone 17 so as to disperse the toner particles substantially uniformly throughout the liquid carrier. The toner particles, disseminated through the liquid carrier, pass by electrophoresis to the electrostatic latent image. The charge of the toner particles is opposite in polarity to the charge on the photoconductive surface.

By way of example, the insulating liquid carrier may be a hydrocarbon liquid although other insulating liquids may also be employed. A suitable hydrocarbon liquid is an Isopar which is a trademark of the Exxon Corporation. There is an increased tendency to use liquid carriers such as mineral oil whose structural properties are less volatile, and thereby emit a lower amount of vapor into the atmosphere, consequently emitting fewer harmful and offensive odors. The toner particles comprise a binder and a pigment. However, one skilled in the art will appreciate that any suitable liquid development material may be employed.

Development station C includes porous roller 18. Roller 18 encounters the developed image on belt 2 and conditions the image by reducing fluid content while inhibiting the departure of toner particles from the image, and by electrostatically compacting the toner particles of the image. Thus, an increase in percent solids is provided to the developed image, thereby improving the quality of the developed image. Porous roller 18 will be described hereinafter with reference to FIG. 2, and in greater detail with reference to FIGS. 3 through 6. Porous roller 18 operates in conjunction with vacuum 19 for removal of liquid from the roller. A roller (not shown), in pressure against the blotter roller, may be used in conjunction with or in the place of the vacuum, to squeeze the absorbed liquid carrier from the blotter roller for deposit into a receptacle. A blotter roller of the type having a pressure roller for removal of liquid from the blotter roller is described in, for example, U.S. patent Ser. No. 08/082,141, having a common assignee as the present application, the relevant portions of which are hereby incorporated herein by reference.

An electrical potential is applied to roller 18 from a high voltage bias supply 53, through a contact (shown with reference to FIG. 3) on the side of roller so that an electrical field is created through a thin wire mesh or wire cloth layer (shown and described with reference to FIGS. 3 through 6, reference numeral 52) along the surface of the roller. This enables a uniform electrical field to be created along the surface of the roller and the adjacent image bearing member. The electric field, having the same sign polarity as the toner particles, repels the toner particles of the image and inhibits their entry to the roller 18. The toner image on the adjacent image bearing member is electrostatically conditioned by the roller, by the removal of liquid carrier dispersant therefrom and the physical stabilization of the toner image.

In operation, roller 18 rotates in direction 20 to encounter the "wet" image on belt 2. The porous body of roller 18 absorbs excess liquid from the surface of the image through the porous skin covering, while conditioning the image on belt 2. Vacuum 19 located on one end of the central cavity of the roller, draws liquid that has permeated through roller 18 out through the cavity and deposits the liquid in a receptacle or some other location which will allow for either disposal or recirculation of the liquid carrier. Porous roller 18, discharged of excess liquid, continues to rotate in direction 20 to provide a continuous absorption of liquid from the image on belt 2.

After the electrostatic latent image is developed, belt 2 advances the developed image to transfer station D. At transfer station D, a sheet of support material 22 is advanced from stack 23 by a sheet transport mechanism, indicated generally by the reference numeral 24. Transfer station D includes a corona generating device 25 which sprays ions onto the backside of the sheet of support material 22. This attracts the developed image from the photoconductive surface of belt 2 to copy sheet 22. After transfer, conveyor belt 26 moves the copy sheet 22 to fusing station E.

Fusing station E includes a fuser assembly indicated generally by the reference numeral 27, which permanently fuses the developed image to the copy sheet 22. Fuser assembly 27 includes a heated fuser roll 28 and back-up pressure roll 29 resiliently urged into engagement with one another to form a nip through which the copy sheet 22 passes. After fusing, the finished copy sheet 22 is discharged to output tray 30 for removal by the machine operator.

After the developed image is transferred to copy sheet 22, residual liquid developer material remains adhering to the photoconductive surface of belt 2. A cleaning roller 31 formed of any appropriate synthetic resin, is driven in a direction opposite to the direction of movement of belt 2 to scrub the photoconductive surface clean. It is understood, however, that a number of photoconductor cleaning means exist in the art, any of which would be suitable for use with the present invention. Any residual charge left on the photoconductive surface is extinguished by flooding the photoconductive surface with light from lamps 34.

Figure 2:
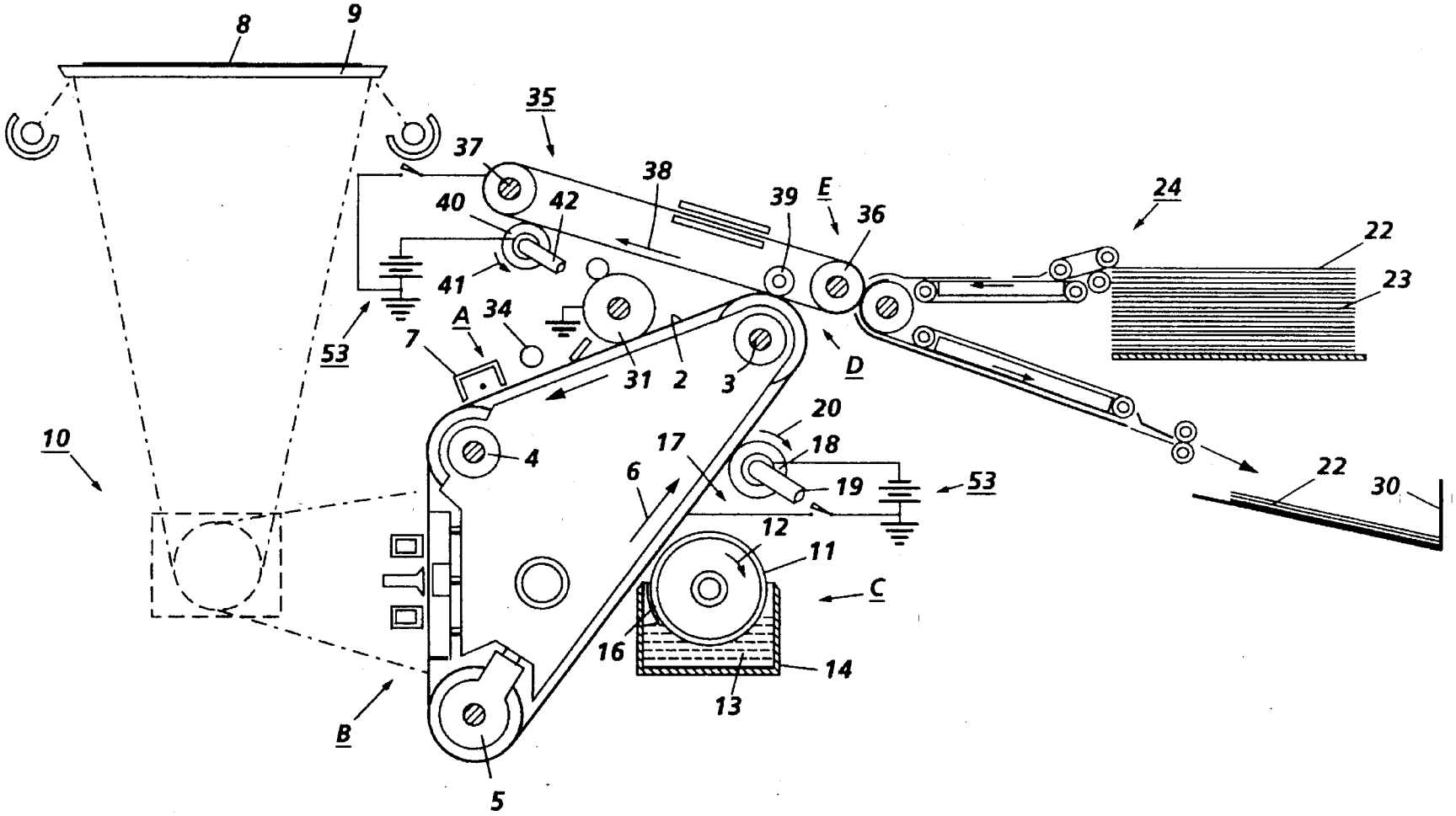
FIG. 2 is a schematic elevational view depicting a portion of another electrophotographic printing machine using an intermediate transfer belt.

FIG. 2 is a schematic representation of a portion of another printing machine which employs a moving image carrying belt, from which an image is transferred to an intermediate belt. Electrostatographic reproduction apparatus utilizing intermediate belts are described, for example, in U.S. Pat. Nos. 4,183,658; 4,684,238; 4,690,539; and 5,119,140. In FIG. 2, elements that are identical to elements in FIG. 1 are identified with like reference numerals. Referring to FIG. 2, there is shown a printing machine employing belt 2, which processes an image through stations A, B, and C as previously discussed with reference to FIG. 1. At Development Station C, roller 18 similarly receives the developed image on belt 2 and conditions the image by reducing fluid content while inhibiting the departure of toner particles from the image and also by electrostatically compressing the image. The percent solids in the image is thereby increased. The roller 18 operates in conjunction with vacuum 19 for removal of the liquid carrier and conditioning of the developed toner image. A bias voltage is applied to roller 18 and through wire mesh layer (shown with reference to FIGS. 3–6), so that a uniform electrical field is created having the same sign polarity as the toner image, creating a repelling force near the surface of the roller and adjacent to the image bearing surface, to condition the image and prevent toner particles from leaving the photoconductive surface and entering the roller 18.

After the electrostatic latent image is developed, belt 2 advances the developed image to transfer station D. At transfer station D, the developed liquid image is electrostatically transferred to an intermediate member or belt indicated generally by the reference numeral 35. intermediate belt 35 is entrained about spaced rollers 36 and 37. Intermediate belt 35 moves in the direction of arrow 38. Bias transfer roller 39 imposes intermediate belt 35 against belt 2 to assure image transfer to the intermediate belt 35. The porous blotter roller 40, having a wire mesh layer (shown with reference to FIGS. 3–6), conditions the developed image on belt 35 by reducing fluid content while preventing toner particles from departing from the image and electrostatically compressing the image. The roller 40 increases percent solids to about 25 to 75 wt. % by removing excess liquid carrier in this region increasing solids on the intermediate belt is a particularly important function in a color image developing process utilizing multiple superimposed images of different colors. As illustrated in FIG. 2, the roller of the present invention may be used for absorbing liquid carrier at an increased rate from an image in a system having an intermediate transfer belt, consequently increasing process speed for color imagery.

In operation, roller 40 rotates in direction 41 to impose against the image on belt 35. The porous body of roller 40 absorbs liquid from the surface of the image. The absorbed liquid permeates through roller 40 and into the inner hollow cavity, where a vacuum 42 draws the liquid from the roller 40 into a liquid receptacle (not shown) or some other location which will allow for either disposal or recirculation of the liquid carrier. Porous roller 40, discharged of excess liquid, continues to rotate in direction 41 to provide a continuous absorption of liquid from images on transfer belt 35. A bias voltage 53 is applied to roller 40 and through a wire mesh layer (shown with reference to FIGS. 3–6), so that a uniform electrical field is created having the same sign polarity as the toner image, creating a repelling force near the surface of the roller and adjacent to the image bearing intermediate belt 35. The image is conditioned and toner particles are prevented from leaving the belt surface and entering the roller 40. Roller 40 may be used in conjunction with a pressure roller (not shown) to remove the liquid that has been absorbed into the roller 40.

Belt 35 then advances the developed image to transfer station E. At transfer station E, a sheet of support material 22 is advanced from stack 23 by a sheet transport mechanism, indicated generally by the reference numeral 24. The developed image from the photoconductive surface of belt 35 is attracted to copy sheet 22 due to the bias applied by biased roller 56. After transfer, conveyor belt 45 moves the copy sheet 22 to the discharge output tray 30.

Although the apparatus shown in FIG. 2 shows only a single porous roller 40, multiple porous roller stations can be utilized in accordance with the present invention in conjunction with a single belt or with the transfer of multiple images to an intermediate belt 35.

With reference to FIGS. 3, 4A and 4B, 5 and 6, there is shown detailed structures of different embodiments of the porous blotter roller 18 of development station C of FIGS. 1 and 2, and the porous blotter roller 40 of intermediate belt 35 of FIG. 2. These rollers, with reference to FIGS. 3 through 6, are collectively referred to by the reference numeral 50, and identical elements associated with roller 50 are identified with like reference numerals.

Figure 3:
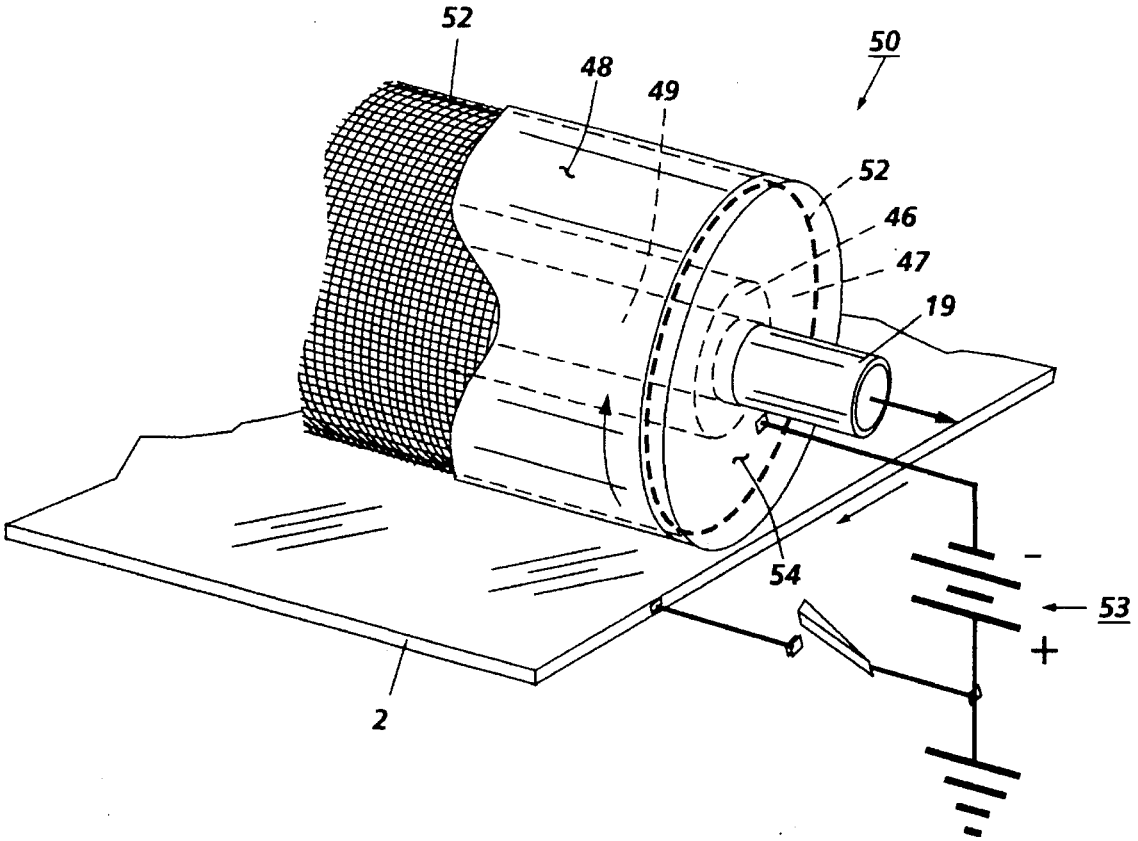
FIG. 3 is an enlarged schematic, perspective, elevational view of an embodiment of a roller used in FIG. 1 and FIG. 2.

With reference to FIG. 3, roller 50 comprises a rigid porous support core 46. In this embodiment, the core 46 is in the form of a tube, having a hollow cavity 49 throughout the length of the roller. A conformable microporous absorbent material 47, and a skin covering 48 are provided around the core 46. A vacuum 19 draws the liquid carrier that has permeated through roller 50 into cavity 49. A high voltage bias supply 53 is connected between the belt 2 and a contact 54 on a side of the roller 50, providing an electrical connection to the wire mesh layer 52. The electrical bias 53 may also connect to other layers of the roller 50 that may be conductive, including a conductive core 46 and an absorbent foam layer 47.

The thin layer of wire mesh 52 completely surrounds an inner layer surface of the roller to ensure a uniform electric field across the length of the roller as the roller approaches an image on the image bearing belt surface 2. The electric field generated by bias supply 53 is of the same polarity as that of the toner particles, so that the toner particles are electrostatically repelled from the roller 50. The wire mesh layer 52 enables the roller's electrical field to be uniformly distributed more closely to the outer surface of the roller and to the adjacent image bearing surface 2. Thus, a stronger repelling action is exerted, which inhibits the departure of the toner particles from the image on the surface and prevents their entry into the roller. Furthermore, the toner particles are electrostatically compacted to the image, enabling physical stabilization of the toner particles of the image. Electrostatic conditioning of the toner image on the adjacent image bearing surface and onto a final support substrate is thereby improved by the present invention. Additionally, the placement of the thin wire mesh layer of the present invention, as illustrated in this embodiment and of those embodiments that follow, permits the reduction of the electrical conductivity requirements of the other layers of the roller, e.g. the absorbent material 47 and the supportive core 46, yet without impeding the flow of the fluid through the roller 50. This advantage is particularly important with respect to the absorbent foam layer 47, where the combination of mechanical strength and porosity are critical factors to the roller's function of separating liquid carrier from the liquid developer image. As the wire mesh layer of the present invention reduces the conductivity requirements of the various roller layers, greater flexibility is provided for selecting materials for these layers that meet the overall porosity and strength requirements of the roller.

The roller is biased from electrical bias source 53 through a contact 54 on the side of the roller 50. The electrical contact is shown here in the form of a slip ring 54, however, it is understood that other methods for applying an electrical contact to the roller 50 and the wire mesh layer 52, which are known in the art, could alternatively be used. For example, a commutate in the form of a metal brush or a resistive carbon fiber brush or pad are suitable for this purpose.

The porous supportive core 46 can be made from a sintered metal, plastic, ceramic or other material, which alone or in combination has the requisite rigidity and porosity for conditioning the liquid developer image. In the instance the core 46 is made from a sintered metal, exemplary metals include stainless steel, copper and bronze. Preferably the material is electroconductive, either by itself, or in combination with another conductive material, so that bias 53 can be applied thereto in conjunction with wire mesh layer 52, and an electrical field will result in a repelling force against the toner particles in the image. By way of example, the pores of the core 46 generally may be of a diameter of 2,500 microns or less. The wire mesh layer of the present invention, however, reduces the electrical requirements of the materials that make up the core 46.

The conformable microporous absorbent material 47 is characterized by open cells forming the layer. The absorbent material 47 may comprise an absorbent polymeric and elastomeric foam material with incorporated conductive filler or dissipative filler. Again, however, the wire mesh layer of the present invention reduces the electrical requirements of the absorbent material. The conformable roller 47 is characterized by a durometer of from 10 to 90 Shore A, preferably from 20 to 60 Shore A, and has a thickness of 1.0 mils to 500 mils, preferably, a thickness of about 40 mils to 250 mils. The absorption material of the microporous roller 47 may be any suitable material, preferably a foam such as one selected from the group consisting of Polyurethane, Silicone, Fluorocarbon, Polyimide, Melamine, and rubber, such as Permair® (a microporous polyurethane material available from Porvair Ltd., England), and Tetratex® (a microporous semipermeable fluorocarbon membrane available from Tetratec Corp., Pennsylvania). Preferably the absorbent material is resistive so that the electric field created by the bias 53 applied to the core 46 and wire mesh layer 52 is uniformly distributed along the surface of the roller 50 and the adjacent image bearing surface 2. A suitable level of resistivity of the absorbent material is in the range of $10^5$ to $10^{11}$ ohm-cm, and is preferably in the range of $10^6$ to $10^9$ ohm-cm.

The open cell pores of the absorbent material 47 generally may be less than 1,000 microns in diameter, and preferably should be in the range of about 5 to about 300 microns, although the end product may use pore sizes outside these limits. For example, very small pores of a micron or less may be used to absorb liquid carrier from an image, however, an increased pressure would then be required to extract an equivalent amount of liquid as that of a roller having larger size pores. An exemplary blotter roller having a rigid porous electroconductive support core and a conformable microporous roller is described in copending application for U.S. patent, Ser. No. 08/107,876, having a common assignee as the present application, the relevant portions of which are hereby incorporated herein by reference. It is understood, however, that other materials known in the art may be satisfactorily used to meet the strength, porosity and conductivity requirements of the blotter roller of the present invention. The materials must, of course, be compatible with whatever liquid carrier material is used.

The vacuum system 19 assists in drawing liquid carrier through the absorbent material of the blotter roller and into the cavity 49, where it is then removed to a collection location. The vacuum system pressure must be adjusted so as to remove only liquid carrier from the image, and not have so strong a suction force so as to also remove the toner. A vacuum pressure of 0.5 inches of water to greater than 45 inches of water, and preferably within the range of 1.0 to about 15 inches of water, has been found to be suitable to the present application. The vacuum pressure and the speed of the roller 50 may in one preferred embodiment be selected to keep the pores of roller filled with liquid carrier, so that liquid carrier is absorbed into the roller at substantially the same rate as liquid carrier is removed therefrom. A blotter roller having a vacuum system associated therewith is described in U.S. Pat. No. 5,332,642, having a common assignee as the present application, the relevant portions of which are hereby incorporated by reference herein.

In a preferred embodiment of the present invention, the skin covering 48 has a smooth, glossy surface texture with micropores which are generally of a smaller size than the toner particles of the liquid developer. A minimal surface area texture of the skin covering is preferred so that toner particles are not encouraged to leave the developed image and embed into larger sized pores and/or the irregularities of a rougher skin surface having a greater surface area texture. The covering 48 should be of a texture and a capillary wetting level so that it is substantially impervious to toner particles, yet pervious to liquid carrier, to inhibit toner particles from departing the image.

Figure 4A:
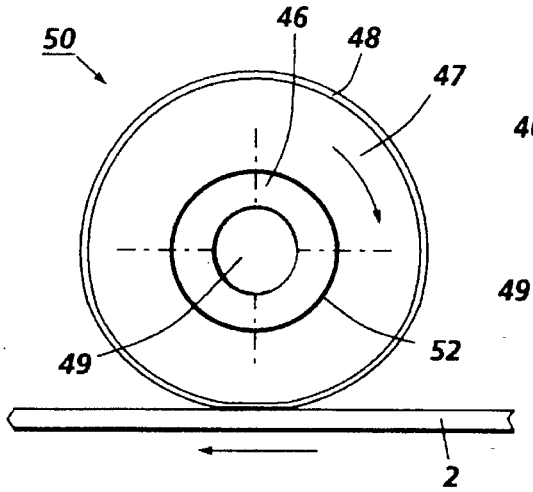
FIG. 4A is an enlarged schematic, sectional side elevational view of an embodiment of a roller used in FIG. 1 and FIG. 2.
Figure 4B:
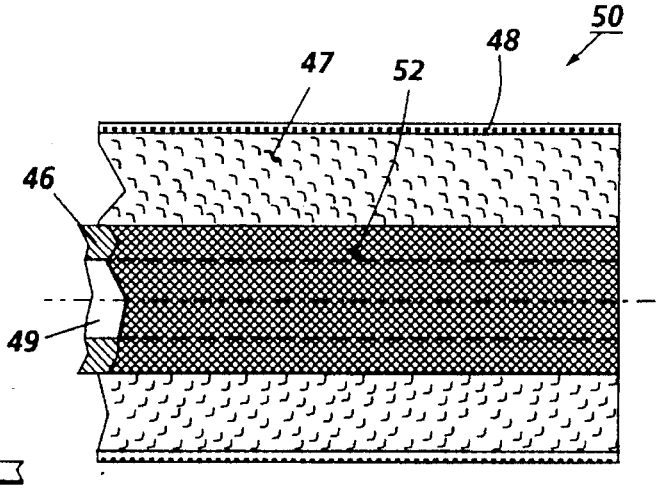
FIG. 4B is an enlarged schematic, sectional front elevational view of an embodiment of a roller used in FIG. 1 and FIG. 2.

FIGS. 4A and 4B show a front and side sectional view of another embodiment of the present invention, where the wire mesh layer 52 is positioned between the core 46 and absorbent material 47.

Figure 5:
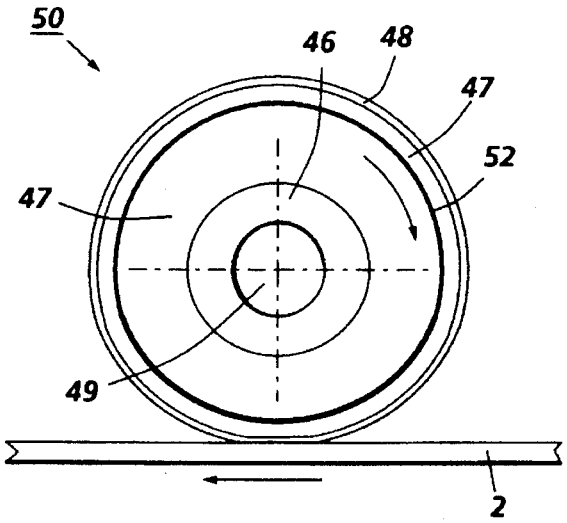
FIG. 5 is an enlarged schematic, sectional, elevational view of an embodiment of a roller used in FIG. 1 and FIG. 2.

FIG. 5 shows another embodiment of the present invention where the wire mesh layer 52 is positioned between two layers of the absorbent material layer 47.

Figure 6:
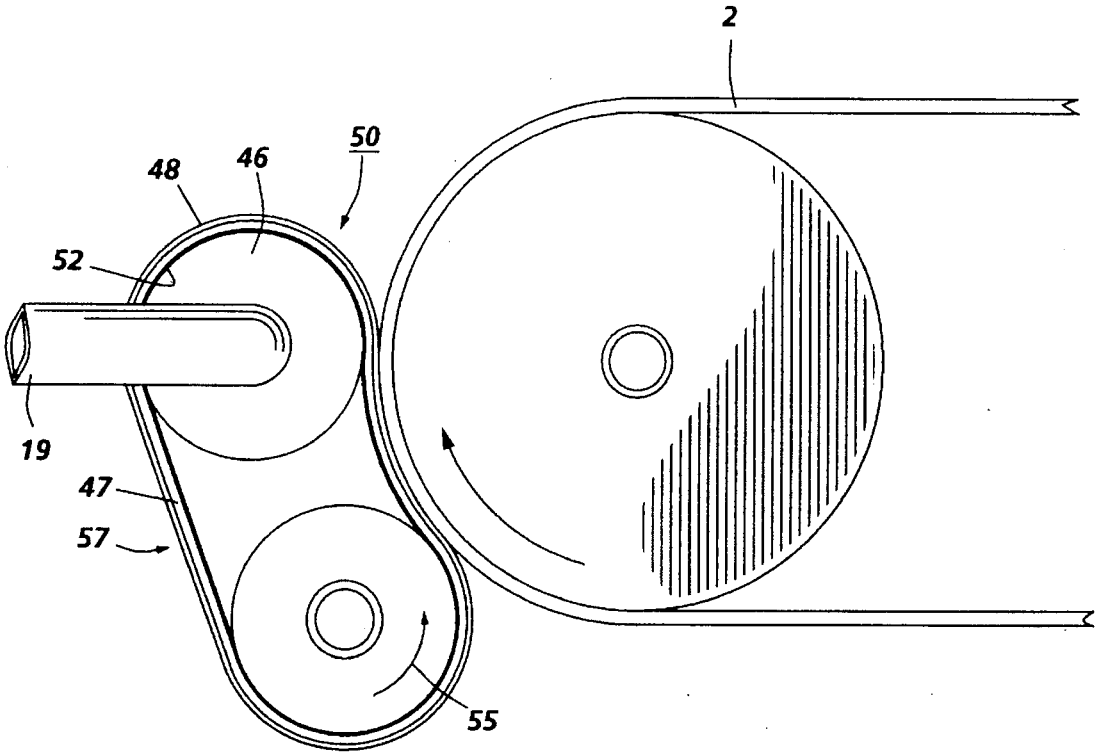
FIG. 6 is an enlarged schematic, sectional, elevational view of an embodiment of a roller used in FIG. 1 and FIG. 2.

In another embodiment of the invention and as shown in FIG. 6, the vacuum assisted liquid absorbing roller of the present invention is in the form of a belt 57, whereby excess liquid carrier is absorbed through an absorbent foam layer 47 of the belt, and a wire mesh layer 52 is incorporated thereabout. The belt passes around a vacuum 19 assisted porous blotter roller 50 and an idler roller 55. A belt used for collecting excess liquid from a region of liquid developed images having a vacuum assist is described U.S. Pat. No. 5,332,642, and U.S. patent Ser. No. 08/082,141, both having a common assignee as the present application, the relevant portions of which are hereby incorporated by reference herein.

While the invention has been described with reference to particular preferred embodiments, the invention is not limited to the specific examples shown, and other embodiments and modifications can be made by those skilled in the art without departing from the spirit and scope of the invention and claims.

What is claimed is:

1. A device for conditioning a liquid image including liquid carrier and toner particles, comprising:

a porous member pervious to the liquid carrier and substantially impervious to the toner particles;

means for applying an electrical bias to said porous member; and a wire mesh associated with said porous member to substantially uniformly distribute the electrical bias about said porous member for electrostatically repelling the toner particles from said porous member.

2. A device as claimed in claim 1, wherein said porous member comprises a roller.

3. A device as claimed in claim 2, wherein said roller comprises:

a rigid porous core adapted to absorb the liquid carrier;

a conformable open cell porous absorption material having an inner surface and an outer surface and adapted to absorb the liquid carrier, the inner surface of said absorption material mounted around said core; and a porous covering in contact with a portion of the outer surface of said absorption material, said covering having a smooth surface, said wire mesh being positioned between said covering and said core, and said wire mesh uniformly surrounding said core, for distributing the bias uniformly and in close proximity to said covering.

4. A device as claimed in claim 3, wherein said rigid core defines a cavity.

5. A device as claimed in claim 4, wherein said removal means comprises a vacuum source in communication with the cavity of said absorption material to adjust the pressure therein so that the rate of absorption of liquid carrier into said absorption material is substantially equal to the rate of removal of liquid carrier therefrom.

6. A device as claimed in claim 3, further comprising removal means for removing liquid carrier from said absorption material at substantially the same rate as absorption of the liquid carrier into said absorption material.

7. A device as claimed in claim 6, wherein said removal means comprises a vacuum source in communication with said absorption material to adjust the pressure therethrough so that the rate of absorption of liquid carrier into said absorption material is substantially equal to the rate of removal of liquid carrier therefrom.

8. A device as claimed in claim 3, wherein said covering is substantially impervious to toner particles and pervious to liquid carrier to inhibit toner particles from departing the image.

9. A device as claimed in claim 3, wherein said rigid core is electroconductive and coupled to said biasing means, so that the toner particles are further repelled.

10. A device as claimed in claim 3, wherein said absorption material is resistive.

11. A device as claimed in claim 10, wherein said absorption material has a resistivity in the range of about $10^5$ ohm-cm to about $10^{11}$ ohm-cm.

12. A device as claimed in claim 3, wherein said wire mesh is positioned between said core and said absorbent material.

13. A device as claimed in claim 3, wherein said wire mesh is positioned between said absorbent material and said covering.

14. A device as claimed in claim 1, wherein the electrical bias distributed through said wire mesh is of the same polarity as the toner particles, so as to electrostatically repel the toner particles from the roller and inhibit their entry into the roller.

15. A printing machine of the type having a surface, with an image developed with a liquid developer comprising liquid carrier and toner particles, and a device for conditioning the liquid image, comprising:

a porous member pervious to the liquid carrier and substantially impervious to the toner particles;

means for applying an electrical bias to said porous member; and a wire mesh associated with said porous member to substantially uniformly distribute the electrical bias about said porous member for electrostatically repelling the toner particles from said porous member.

16. A machine as claimed in claim 15, wherein said porous member comprises a roller.

17. A machine as claimed in claim 16, wherein said roller comprises:

a rigid porous core adapted to absorb the liquid carrier;

a conformable open cell porous absorption material having an inner surface and an outer surface and adapted to absorb the liquid carrier, the inner surface of said absorption material mounted around said core; and a porous covering in contact with a portion of the outer surface of said absorption material, said covering having a smooth surface, said wire mesh being positioned between said covering and said core, and said wire mesh uniformly surrounding said core, for distributing the bias uniformly and in close proximity to said covering.

18. A machine as claimed in claim 17, wherein said rigid core defines a cavity.

19. A machine as claimed in claim 17, further comprising removal means for removing liquid carrier from said absorption material at substantially the same rate as absorption of the liquid carrier into said absorption material.

20. A machine as claimed in claim 19, wherein said removal means comprises a vacuum source in communication with said absorption material to adjust the pressure therethrough so that the rate of absorption of liquid carrier into said absorption material is substantially equal to the rate of removal of liquid carrier therefrom.

21. A machine as claimed in claim 19, wherein said removal means comprises a vacuum source in communication with the cavity of said absorption material to adjust the pressure therein so that the rate of absorption of liquid carrier into said absorption material is substantially equal to the rate of removal of liquid carrier therefrom.

22. A machine as claimed in claim 17, wherein said covering is substantially impervious to toner particles and pervious to liquid carrier to inhibit toner particles from departing the image.

23. A machine as claimed in claim 17, wherein said rigid core is electroconductive and coupled to said biasing means, so that the toner particles are further electrostatically repelled.

24. A machine as claimed in claim 17, wherein said absorption material is resistive.

25. A machine as claimed in claim 24, wherein said absorption material has a resistivity in the range of about $10^5$ ohm-cm to about $10^{11}$ ohm-cm.

26. A machine as claimed in claim 17, wherein said wire mesh is positioned between said core and said absorbent material.

27. A machine as claimed in claim 17, wherein said wire mesh is positioned between said absorbent material and said covering.

28. A machine as claimed in claim 15, wherein the electrical bias distributed through said wire mesh is of the same polarity as the toner particles, so as to repel the toner particles from the roller and inhibit their entry into the roller.

29. A device for conditioning a liquid image including liquid carrier and toner particles, comprising:

a roller having a rigid porous core adapted to absorb a liquid carrier; a conformable open cell porous absorption material having an inner surface and an outer surface and adapted to absorb the liquid carrier, the inner surface of said absorption material mounted around said core; and a porous covering in contact with a portion of the outer surface of said absorption material, said covering having a smooth surface;

means for applying an electrical bias to said roller; and a wire mesh positioned between said covering and said core and in close proximity to said covering, said wire mesh for substantially uniformly distributing said electrical bias about said roller for electrostatically repelling toner particles from said roller;

wherein said absorption material, said wire mesh, and said covering are in the form of a belt, and wherein the inner surface of said absorption material is mounted around said core and a second roller.

* * * * *